US009370257B2

(12) United States Patent
Roberts et al.

(10) Patent No.: US 9,370,257 B2
(45) Date of Patent: Jun. 21, 2016

(54) FOLDABLE INFANT POSITIONER WITH A SOFTGOODS SEAT

(71) Applicant: Mattel, Inc., El Segundo, CA (US)

(72) Inventors: Devin J. Roberts, Lackawanna, NY (US); Kurt J. Huntsberger, Arcade, NY (US); Brian F. Murty, Depew, NY (US)

(73) Assignee: Mattel, Inc., El Segundo, CA (US)

( * ) Notice: Subject to any disclaimer, the term of this patent is extended or adjusted under 35 U.S.C. 154(b) by 50 days.

(21) Appl. No.: 14/203,703

(22) Filed: Mar. 11, 2014

(65) Prior Publication Data

US 2014/0265514 A1 Sep. 18, 2014

Related U.S. Application Data

(60) Provisional application No. 61/783,493, filed on Mar. 14, 2013.

(51) Int. Cl.
*A47C 7/00* (2006.01)
*A47D 13/08* (2006.01)

(52) U.S. Cl.
CPC ..... *A47D 13/08* (2013.01)

(58) Field of Classification Search
CPC ..... A47D 1/002; A47D 1/02; A47D 1/10; A47D 13/00; A47D 13/08
See application file for complete search history.

(56) References Cited

U.S. PATENT DOCUMENTS 2,777,138 A * 1/1957 Gallagher ..... 5/655
2,927,628 A * 3/1960 Gill ..... 248/585
2,988,136 A * 6/1961 Kowalczyk ..... 297/311
3,004,793 A * 10/1961 Loomis ..... 297/274
3,017,220 A 1/1962 Chernivsky
4,948,120 A * 8/1990 Krueger et al. ..... 297/274
5,213,360 A * 5/1993 Lin ..... 280/648
D343,958 S 2/1994 Greenwood
5,308,143 A 5/1994 Cheng et al.
5,375,869 A * 12/1994 Hsiao ..... 280/648
5,509,721 A 4/1996 Huang (Continued)

FOREIGN PATENT DOCUMENTS

GB 846092 A 8/1960
GB 2139881 A 11/1984

(Continued)

OTHER PUBLICATIONS

Combined Search and Examination Report Application GB1404242.8, Aug. 18, 2014.

*Primary Examiner* — Philip Gabler
(74) *Attorney, Agent, or Firm* — Edell, Shapiro & Finnan, LLC

(57) ABSTRACT

A foldable infant positioner with a softgoods seat is a seating apparatus that includes a softgoods seat and a hardgoods foldable support structure. The support structure includes a seat support that is movably coupled to a ground engaging section so that the support structure can move between a deployed configuration and a stored configuration. The seat may be removably secured to the seat support by folding a top portion of the seat over and around the seat support and then coupling the seat thereto. The seat may also have a front flap which extends beneath the seat and prevents an infant's feet from directly contacting the support surface when an infant is disposed in the seat, in an upright seated position, thus preventing the infant from pushing down on the front flap and tipping the infant positioner over.

20 Claims, 5 Drawing Sheets

(56) References Cited

U.S. PATENT DOCUMENTS

| | | | | |
|---|---|---|---|---|
| 6,594,840 | B2 | 7/2003 | Tomas et al. | |
| D507,121 | S | 7/2005 | Eyman et al. | |
| 7,044,547 | B2 | 5/2006 | Sorrenti | |
| 7,356,861 | B1 | 4/2008 | Pagano | |
| 7,523,984 | B2 * | 4/2009 | Steininger | 297/16.1 |
| D612,621 | S | 3/2010 | Ekstrom | |
| 8,070,617 | B2 | 12/2011 | Barron et al. | |
| 8,079,639 | B2 | 12/2011 | Zeng et al. | |
| 8,267,803 | B2 | 9/2012 | Trapp et al. | |
| 8,439,765 | B2 | 5/2013 | Barron et al. | |
| 8,567,867 | B2 | 10/2013 | Arnold, IV et al. | |
| 2009/0008971 | A1 * | 1/2009 | Ellsworth | 297/184.11 |
| 2011/0012408 | A1 | 1/2011 | Lee et al. | |

FOREIGN PATENT DOCUMENTS

| | | | |
|---|---|---|---|
| GB | 2227930 | A | 8/1990 |
| GB | 2507530 | A | 5/2014 |

* cited by examiner

FOLDABLE INFANT POSITIONER WITH A SOFTGOODS SEAT

CROSS-REFERENCE TO RELATED APPLICATION

This application claims priority to and is based on U.S. Patent Application No. 61/783,493, filed Mar. 14, 2013, entitled "Foldable Infant Positioner with a Softgoods Seat," the entire disclosure of which is incorporated herein by reference in its entirety.

FIELD OF THE INVENTION

The present invention relates to a seating apparatus for infants. More specifically, the present invention relates to an upright seating apparatus with a softgoods seat that can be repositioned between a deployed configuration and a storage configuration.

BACKGROUND OF THE INVENTION

A crucial step in infant development is learning how to sit upright. Initially, infants will not have the requisite neck strength or motor skills to control movements of their head and properly balance themselves to sit upright. As a infant's muscles and motor skills develop, the child will being to learn how control their head and how to balance themselves with their legs, typically learning how to sit between the ages of four and seven months. Before an infant can sit on his or her own, he or she may be propped up in an infant seat or other such structure for feeding, cleaning, or teaching muscle memory while allowing the baby to see his or her surroundings.

While many infant seats which allow a baby to be placed in an upright position are known, there are drawbacks associated with many of these seats. For example, because many known infant seats are made from only hardgoods, such as plastic, many of the known seats improperly allow use with a bathtub or bathing apparatus. Similarly, many basic infant seats include bases with small footprints and, thus, may allow or encourage a parent to place the unrestrained infant seat on an elevated surface, which can also be dangerous for a baby. For example, if a baby kicks or pushes off the support surface, the baby can knock the seat from the surface and fall from the elevated surface to the ground. Furthermore, even when seats with small bases are not placed on elevated support surfaces, the seats may still pose a threat of injury because a baby may be able to push off the support surface and tip or flip the seat over. While solutions to some of these problems could involve an extremely large base or seat that cannot fit atop of an elevated surface or in a bathtub, such a large seat is burdensome for a parent to use, move, and store. In light of this, a storable infant seat that places the infant in an upright position, discourages placement on an elevated surfaces or in a tub, and prevents the baby from flipping or moving the seat, regardless of the support surface the seat is placed upon, is desirable.

SUMMARY OF THE INVENTION

According to at least one embodiment of the present invention, a foldable infant positioner includes a softgoods seat including leg openings to allow the legs of a child to extend at least forwardly of or beneath the softgoods seat and a support structure. The support structure includes a seat support and a ground engaging portion. The softgoods seat is configured to be removably coupled to the seat support and the ground engaging portion is configured to engage a support surface. The ground engaging portion extends beyond the periphery of the seat support and is pivotally coupled to the seat support such that the support structure is reconfigurable between a deployed configuration and a storage configuration and the infant positioner is configured to resist movement while in the deployed configuration.

In some embodiments of the present infant positioner, the seat support is substantially parallel or even coplanar with the ground engaging portion in the storage configuration and the seat support is disposed a larger distance above the ground engaging portion in the deployed configuration, such that the infant positioner may support a child above the support surface in the deployed configuration. In other embodiments, the softgoods seat also includes a top portion that is foldable with respect to the remainder of the softgoods seat, and the top portion of the softgoods seat is configured to fold around the seat support while the remainder of the seat remains disposed within and hanging below the seat support.

In yet other embodiments of the present infant positioner, the infant positioner also includes at least one support arm that movably couples the seat support to the ground engaging portion. In some of these embodiments, the at least one support arm is coupled to the seat support via a pivotable or rotatable joint. In other embodiments, the at least one support arm includes a rotatable joint that fixedly couples the at least one support arm to the ground engaging portion adjacent to the rotatable joint, such that the rotatable joint allows the at least one support arm to be rotatable with respect to the ground engaging portion.

In still further embodiments of the present infant positioner, the softgoods seat includes a front flap, the flap extending outwardly from the seat and, when an infant is disposed in the seat, the flap extending between the infant's feet and the support surface, preventing the infant from contacting the support surface. In some of these embodiments, the ground engaging portion includes a front portion and a rear portion and the flap is removably coupleable to the front portion. In other embodiments, the flap is substantially T-shaped.

According to at least one other embodiment of the present invention, an infant positioner includes a softgoods seat including a child receiving portion and a flap and a support structure configured to selectively support the softgoods seat at a distance above the support surface. The child receiving portion includes leg openings to allow the legs of a child to extend below the child receiving portion and the flap extends between the leg openings and a support surface such that the flap prevents the infant from contacting the support surface.

In some embodiments of the above infant positioner, the support structure includes a seat support configured to removably receive the softgoods seat therein, a ground engaging portion extending beyond the periphery of the seat support, and at least one support arm movably coupling the seat support to the ground engaging portion. In some of these embodiments, the seat support is rotatably coupled to the at least one support arm. In other embodiments, the at least one support arm is pivotally mounted to the ground engaging portion. In yet other embodiments, the support structure is movable between a deployed configuration and a storage configuration; the seat support being adjacent to the ground engaging portion in the storage configuration and being disposed a distance away from the ground engaging portion in the deployed configuration. The infant positioner is configured to statically position an infant disposed within the softgoods seat in an upright seated position when the support structure is in the deployed configuration in some of these embodiments.

In yet other embodiments of the present infant positioner, the support structure includes a front portion and a rear portion and the flap is coupled to the softgoods seat at a first end and coupled to the front portion of the support structure at a second end, the second end being end being opposite the first end. In still other embodiments, the softgoods seat is configured so that an infant placed therein can only access the softgoods portion of the infant positioner.

According to at least one other embodiment of the present invention, a foldable infant positioner includes a support structure configured to engage a support surface and a softgoods seat including leg openings configured to allow the legs of a child to extend below the child receiving portion. The softgoods seat is mountable on the support structure and the support structure is reconfigurable between a deployed configuration and a storage configuration. The support structure supports the softgoods seat in a position above the support surface in the deployed configuration and the seat prevents a child seated therein from directly contacting the support surface.

In some embodiments of the present foldable infant positioner, The softgoods seat includes a child receiving portion and a flap extending outwardly from the child receiving portion and the flap prevents a child seated in the softgoods seat from directly contacting the support surface. In other embodiments, the support structure includes a seat support configured to removably receive the softgoods seat therein, a ground engaging portion extending beyond the periphery of the seat support, and at least one support arm movably coupling the seat support to the ground engaging portion so that the support structure is reconfigurable between the deployed configuration and the storage configuration.

BRIEF DESCRIPTION OF THE DRAWINGS

Like reference numerals have been used to identify like elements throughout this disclosure.

DETAILED DESCRIPTION OF THE INVENTION

Generally referring to FIGS. 1-8B, at least one exemplary embodiment of a foldable infant positioner with a softgoods seat according to the present invention is shown. The infant positioner includes a softgoods seat and a large, hardgoods, support structure to discourage placement on an elevated support surface, such as a chair or countertop. Similarly, the size of the infant positioner, as well as the softgoods material included on the seat, serve to discourage the infant positioner from being placed in a bathtub. The softgoods seat may also serve to prevent a child from contacting the support surface, thereby preventing a child from moving or tipping the seat while seated therein. Furthermore, the present infant positioner is easy to maneuver and store due to the foldable and tube-like configuration of the support structure, insofar as "tube-like" may be used to describe a support structure that is constructed from tubular or partially tube-shaped pieces.

Figure 1:
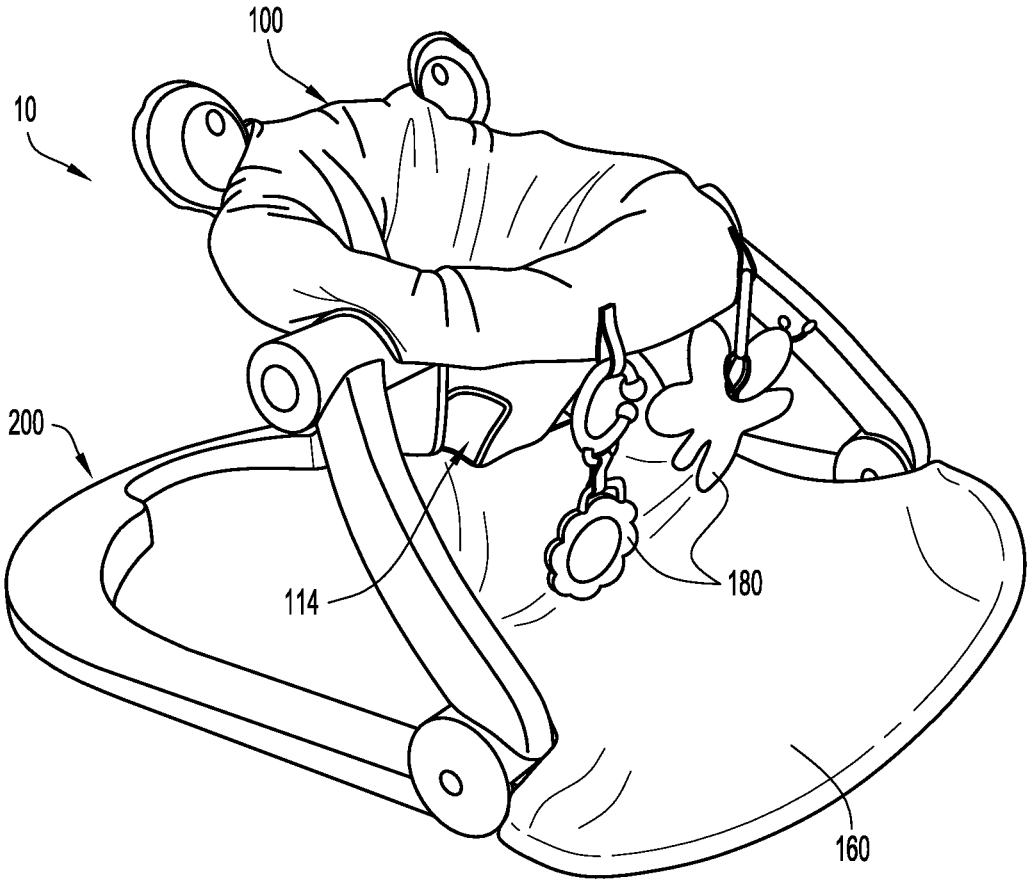
FIG. 1 shows a perspective view of an exemplary embodiment of a foldable infant positioner with a softgoods seat, including a hardgoods support structure in accordance with the present invention.

Referring now to FIG. 1, in one preferred embodiment, a foldable infant positioner with a softgoods seat 10 includes a softgoods infant receiving portion 100 (alternatively referred to as seat 100) and a support structure 200. However, while the seat 100 is referred to as a softgoods seat, it is to be understood that the seat 100 may include some parts or portions manufactured from non-softgoods material, if desired. The infant positioner 10 may also include toys 180, such as teethers, rattles or plush toys, coupled to any portion thereof. Preferably, any toys 180 coupled to the positioner 10 are coupled proximate to where an infant's hands would be disposed when seated in the positioner 10. In some embodiments, the positioner 10 may even include a tray removably coupled thereto in a similar position to aid in feeding, serve as a play table, or for any other desirable purpose. Furthermore, the entire positioner 10 may be designed to resemble an animal, environment or theme, as desired, to further increase the appeal of the apparatus.

Figure 2A:
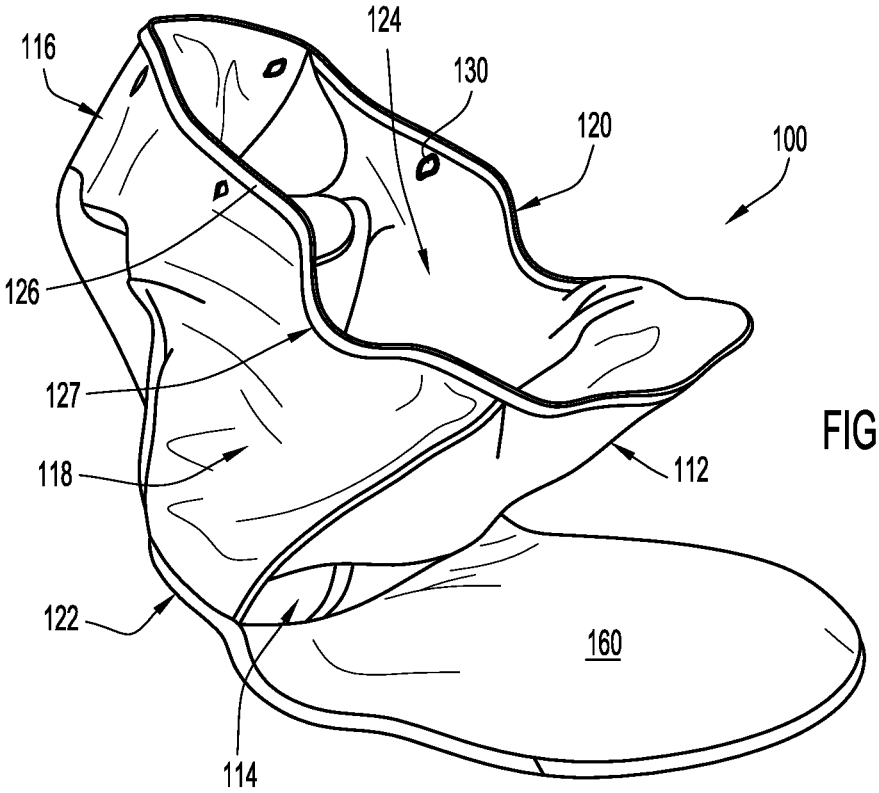
FIG. 2A shows a perspective view of an exemplary embodiment of a softgoods seat for a foldable infant positioner in accordance with the present invention.

Turning now to FIG. 2A, an embodiment of a seat 100 is shown from a perspective view while removed from its support structure 200. As can be seen, the seat includes a front wall 112, a rear wall 116, and first and second side walls 118, 120, respectively, extending therebetween. The seat also includes a bottom wall 122 that extends between each of the lower edges of walls 112, 116, 118, and 120. Together, the front, rear, first, second and bottom walls 112, 116, 118, 120, and 122 form an interior cavity 124 configured to receive a child. In order to ensure that a child placed therein is comfortable, the front wall 112 may also include leg openings 114 to allow the child's legs to hang in front of wall 112 and/or beneath wall 122. In other embodiments, leg openings 114 may be included in bottom wall 122.

Figure 2B:
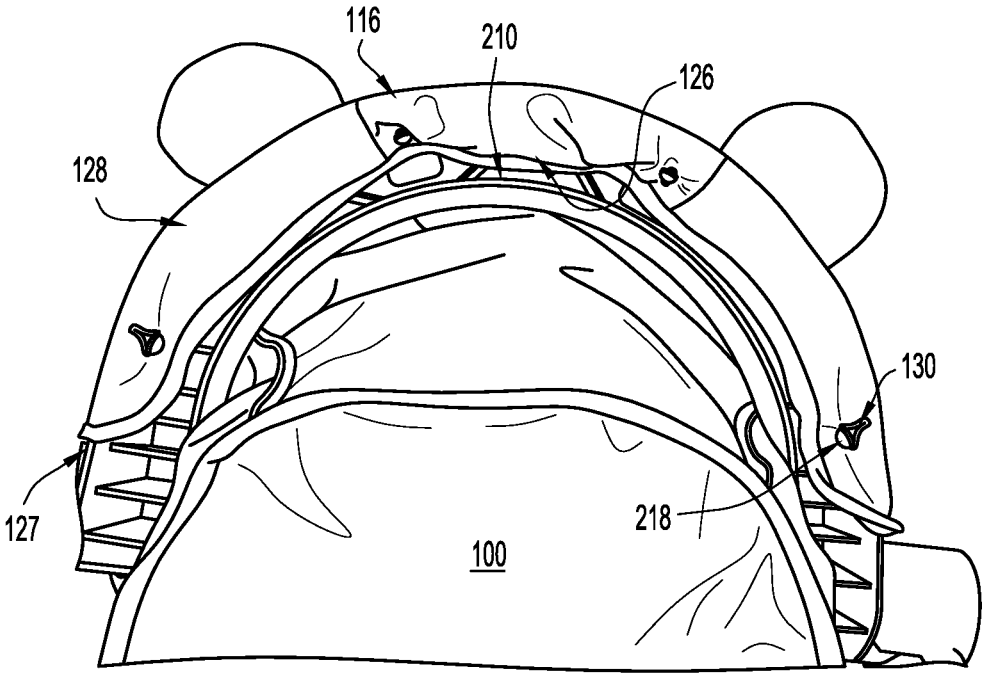
FIG. 2B shows a bottom perspective view of a portion of another exemplary embodiment of a softgoods seat for a foldable infant positioner coupled to a support structure.
Figure 3:
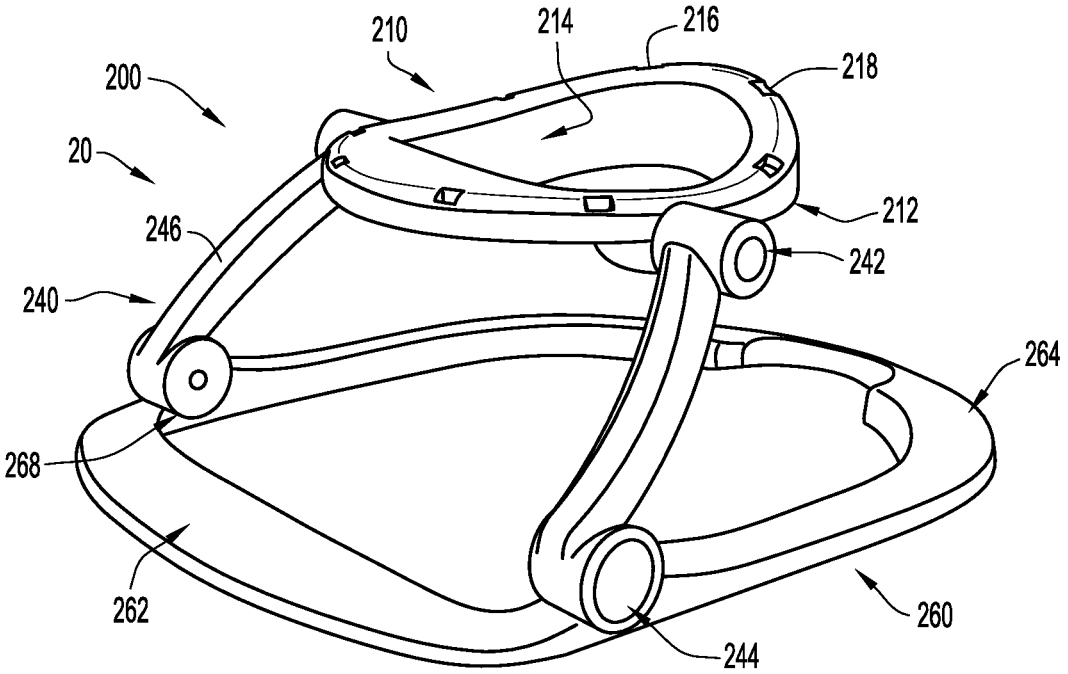
FIG. 3 shows a side perspective view of the support structure of the exemplary embodiment shown in FIG. 1 in a deployed configuration.

Now referring to FIG. 2B, but with reference to FIGS. 1, 2A, and 3 as well, seat 100 includes a foldable top portion 128 which can be rolled or folded over a portion of support frame 200 in order to mount or couple the seat 100 to the support frame 200. More specifically, and as can be seen best in FIG. 2A, together, walls 112, 116, 118, and 120 form a continuous top edge 126. Top edge 126 can be contoured so that seat 100 may substantially cover a top wall 216 of a seat support 210 of the support structure 200 (See FIG. 3). Thus, once the seat 100 is placed within the support structure, the foldable top portion 128 may fold over and/or around the top wall 216 of the seat support 210, while the remaining portion of seat 100 may hang below seat support 210, such that a child placed therein is sitting substantially below seat support 210, in a substantially upright position, and is substantially surrounded by the soft material of the seat 100. Thus, seat support 210 may essentially serve as an arm rest or tray with a plush, softgoods cover for the child to rest her arms upon.

In a preferred embodiment, and as shown in FIG. 2A, the front wall 112 may have a convex top edge 126 with an apex that is raised above the top edge 126 of the first and second side walls 118, 120. Thus, front wall 112 may be able to cover any tray or tray-like areas included on the front of seat support 210. Similarly, back wall 116 may also be shaped to be slightly convex so that it may cover any raised back or back rest included in the seat support 210. Furthermore, the top edge 126 may include dips or concavities 127 at the top of side walls 118, 120 so that the seat 100 may be wrapped around any couplers or joints include in the support structure 200. Although the shape of top edge 126 shown in FIG. 2A is preferred, it is to be understood that top edge 126 may be shaped as desired in order to fit or accommodate any desirable frame.

Figure 7:
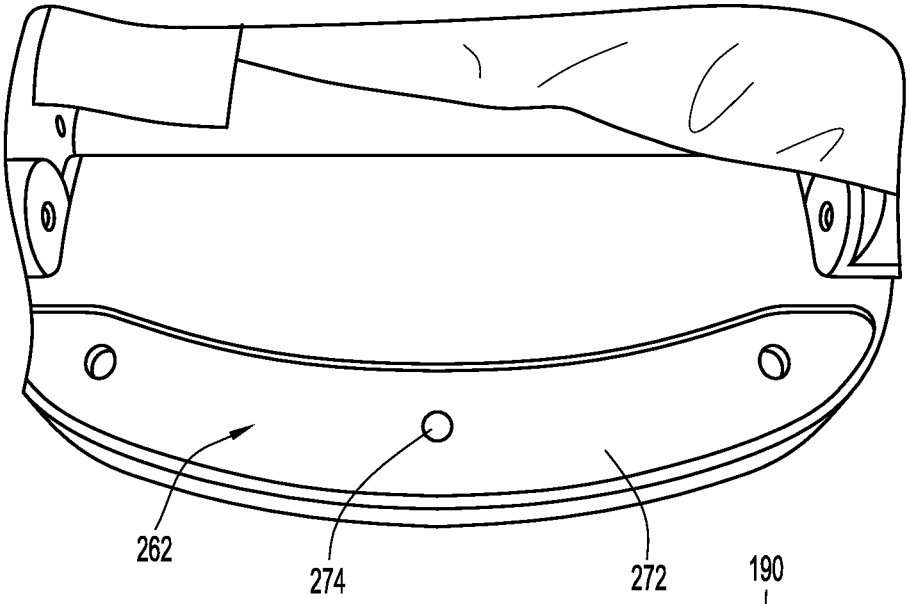
FIG. 7 shows a top view of a front portion of another exemplary embodiment of a support structure for a foldable infant positioner in accordance with the present invention.
Figure 8B:
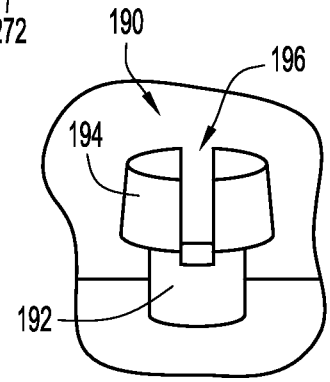
FIG. 8B shows a portion of the flap shown in FIG. 8A.

Still referring to FIGS. 1 and 2A, seat 100 also includes a front flap 160 which extends from either the bottom wall 122 or a lower portion of the front wall 112. In a preferred embodiment, front flap 160 extends from the joint or seam where the front wall 112 is joined to the bottom wall 122. The front flap may be any desirable size or shape provided that it can extend underneath an infant's feet when the infant's feet are extending through leg openings 114. Additionally, in some embodiments, the flap 160 may also include a hardgoods portion, fasteners and/or couplers in order to secure the flap to the support structure, as is shown in FIGS. 7-8B.

For example, in the embodiment shown in FIG. 2A, the front flap 160 is substantially ovular, but in the embodiment shown in FIG. 1, the front flap 160 is substantially T-shaped. However, in some embodiments, such as the embodiment shown in FIG. 8, the flap may be flared or convex such that it may be bent or molded into a substantially T-shaped flap 160 when disposed within the support structure 200. Regardless of the shape, by extending between an infant's feet and the support surface, the front flap 160 may ensure that a child cannot directly contact a support surface that the positioner 10 is placed upon (the seated infant can only indirectly contact the support surface through the front flap 160). Thus, if the infant kicks or pushes downward with her feet on flap 160, the infant will only be pushing against her own weight, preventing the infant's downward push from tipping the positioner 10 over. In fact, any force exerted onto flap 160 by an infant will be directly counteracted by the force of the weight of the infant leaning in the seat, thereby minimizing the impact of any forces exerted by the infant onto flap 160 and preventing the infant's downward push from tipping the positioner 10 over.

In order to ensure that the seat is securely coupled to or mounted on the support structure 200, the seat may also include coupling portions 130 which may engage or be coupled to portions 218 of the seat support 210. Coupling portions 130 and 218 may be included in any desirable parts of portion of seat 100 and support structure 200 and may include any desired coupling mechanism, such as mating segments of hook and loop type fasteners, a hole and corresponding hook or button (as shown in FIGS. 2A-B and 7), or two mating portions of a snap. Regardless, portions 130 and 218 allow seat 100 to be removably coupled to support structure 200. Additionally, in some embodiments, such as the embodiment shown in FIGS. 7-8B, the flap 160 may also be secured to support structure 200. In some embodiments, the flap 160 may include a pocket or receiving section on its lower surface that may simply be slipped over the front portion 262 (see FIG. 3) of the support structure. However, in other embodiments, flap 160 may (or may not) be coupled to support structure 200 at any desirable location in any desirable manner. For example, in the embodiment shown in FIGS. 7-8B, the flap 160 is coupled to the front portion 262 via couplers, as is described in detail below.

Now turning to FIG. 3, a perspective view of the support structure 200 of FIG. 1 without the seat 100 mounted therein is shown. As has been briefly discussed above, the support structure 200 includes a seat support 210 and a surface engaging portion 260 which are coupled together by two support arms 240. However, while the embodiment shown herein includes two support arms 240, it is to be understood that support structure may include one or more support arms 240, as desired. Regardless, as briefly discussed above, the seat support 210 is configured to receive seat 100 while the surface engaging portion 260 is configured to stably maintain support structure 200 on a support surface.

Still referring to FIG. 3, each section of the support structure 200—seat support 210, surface engaging portion 260, and support arms 240—are constructed from tubular parts or other-shaped portions, such that support structure 200 is a light, skeletal-type, frame. However, it is to be understood that parts of the support structure 200 may include solid or hollow parts, such that any or all of the above-identified parts may be substantially hollow, solid, or some combination thereof, as desired.

In particular, seat support 210 is substantially annular shaped and includes an outer wall 212, an inner wall 214 and top and bottom surfaces extending therebetween, top surface 216 and bottom surface 220 (see FIG. 5), respectively. Similarly, surface engaging portion 260 is also substantially annular, as a front portion 262 and rear portion 264 are integrally formed in an ovular, annulus shape with a mounting portion 268 formed therebetween. The ground engaging portion 260 extends beyond the periphery of the seat support 210, with the front portion 262 and rear portion 264 extending forwardly and rearwardly of seat support 210. Due to this configuration, surface engaging portion 260 is able to provide a stable base for the support structure 200. Finally, support arms 240 include a simple arcuate member 246 extending between an upper coupler 242 and a lower coupler 244.

Figure 4:
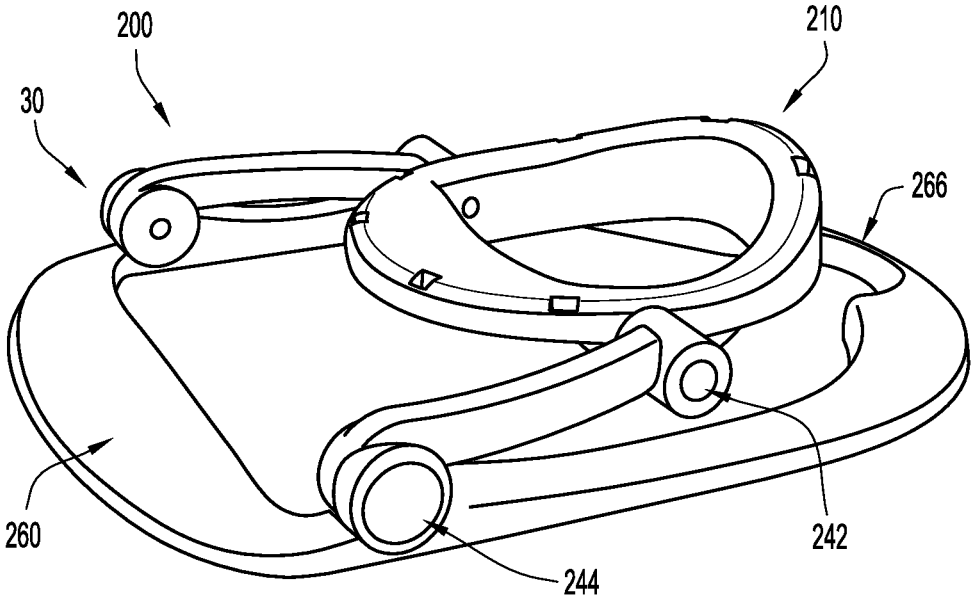
FIG. 4 shows a side perspective view of the support structure of FIG. 3 in a storage configuration.

Now referring to FIGS. 3-4, the support structure 200 is shown in a deployed configuration 20 (FIG. 3) and a folded or storage configuration 30 (FIG. 4). In order to enable support structure 200 to move between these two configurations, coupler 244 pivotally couples support arms 240 to ground engaging portion 260. Thus, seat support 210 may easily move between configurations 20 and 30 when the support arms 240 are pivoted from a substantially upright position to a substantially horizontal position. Similarly, couplers 242 pivotally couple support arms 240 to the non-collapsible seat support 210. However, in other embodiments, couplers 242 may fixedly couple seat support arms 240 to seat support 210. In a preferred embodiment, couplers 242 pivotally couple support arms 240 to seat support 210 such that seat support 210 may move from a deployed configuration 20 to a storage configuration 30 while remaining substantially horizontal throughout the reconfiguration. In other words, coupler 242 may couple support arms 240 to seat support 210 so that seat support 210 remains substantially parallel to a support surface that support structure 200 is resting upon. In order to provide the above-described motions, any desirable joint or coupling may be used as couplers 242, 244. U.S. Pat. No.

6,739,649 to Brian Kelly et al. (incorporated herein by reference) is an example of such a prior art pivotable joint or coupling.

Still referring to FIGS. 3-4, while these figures may show an exemplary deployed configuration 20 and an exemplary storage configuration 30, it is to be understood that support structure 200 does not need to be positioned exactly in the shown positions to be considered to be in these configurations. For example, the deployed configuration 20 is simply intended to denote a configuration in which the seat support 210 is elevated above ground engaging portion 260, such that the seat 100 may extend below seat support 210 and provide a child with a place to sit in an upright position. Similarly, while the seat support 210 is shown slightly above the ground engaging portion in the storage configuration 30 shown in FIG. 4, it is to be understood that in some embodiments the seat support 210 may nest further within ground engaging portion 260, as desired. Storage configuration 30 is simply intended to decrease the overall size of support structure 200 from its size when in deployed configuration 20. Additionally, the ground engaging portion 260 may also include a handle 266 that may facilitate moving the support structure, particularly when it is disposed in a storage configuration 30.

Figure 5:
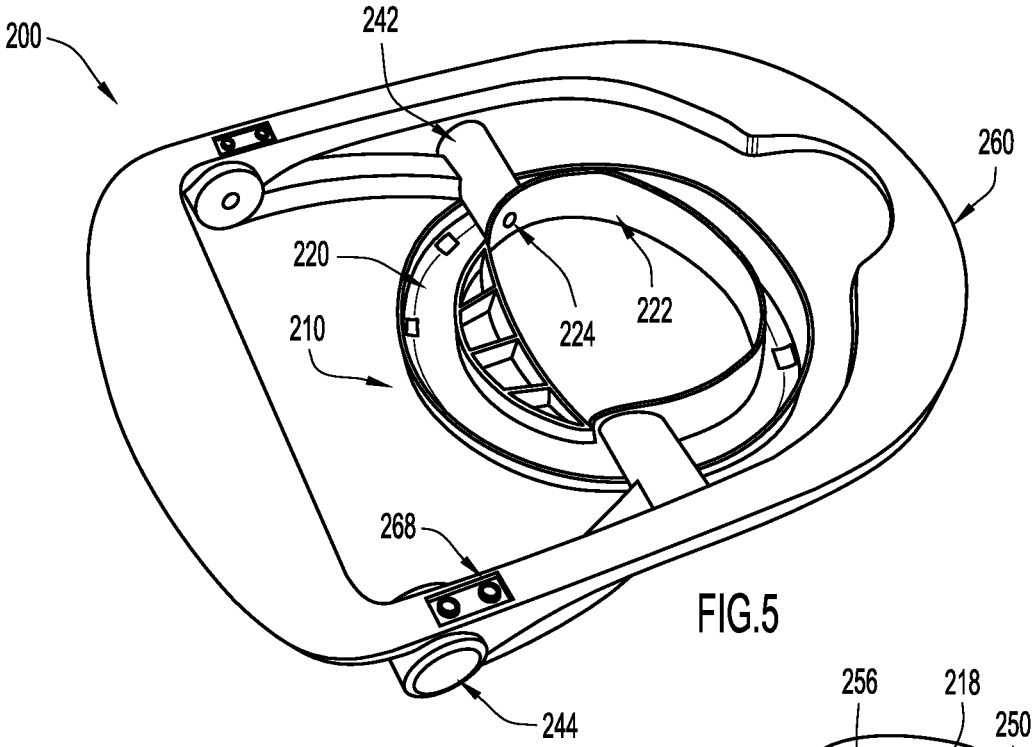
FIG. 5 shows a bottom view of the support structure of FIG. 3 in a storage configuration.

Now referring to FIG. 5, with continued reference to FIG. 3, support structure 200 is shown from a bottom view. From this view, the connections of couplers 242, 244 with seat support 210 and ground engaging portion 260 can be viewed. As is shown, the non-collapsible seat support 210 includes a skirt 222 extending from the bottom surface 220 of seat support 210. The skirt 222 provides mounting points 224 for couplers 242 to engage seat support 210. While any desirable joint could be implemented as couplers 242 and mounting points 224, in this particular embodiment, the mounting point 224 is simply a hole and the couplers 242 include axles, pins, or some other suitable mechanisms which extend therethrough, thereby rotatably coupling support arms 240 to seat support 210.

Additionally, the mounting point 224 and couplers 242 may also include detents or another rotational lock mechanism (not shown, but see U.S. Pat. No. 6,739,649 to Brian Kelly et al. as a prior art example of an appropriate rotational lock mechanism) which may enable the seat 210 to be secured in various positions, as desired, or stops or which may prevent tilting past a certain point, as desired. Alternatively or additionally, any other feature which controls the amount of rotation may also be included as desired. Preferably, couplers 242 include stops to restrict the seat support 210 so that the seat support may only rotate between a substantially flat position with respect to a horizontal plane and a position where the rear of the seat is approximately 30 degrees above the horizontal plane (i.e. the seat is tilted forwards or backwards). In other words, preferably, couplers 242 only allow the seat support 210 to tilt slightly forward or backward as needed to allow the seat support 210 to be repositioned to a horizontal position after the arms 246 are moved from the deployed configuration 20 to the storage configuration 30.

Still referring to FIG. 5, any desirable joint could also be implemented as couplers 244 and mounting points 268. A similar detent or rotational locking feature may also be included in lower couplers 244 and mounting portions 268. However, in contrast with couplers 242, in this exemplary embodiment, couplers 244 do not form a pivot joint with support structure, but, instead, couplers 244 may be a pivot joint. Thus, couplers 244 may include two halves rotatably coupled together, with one half (i.e. the outer half) being fixedly coupled to the ground engaging portion 260 and the other half (i.e. the inner half) being fixedly coupled to a seat support 240. Thus, rotation of the coupler 244 may allow seat support 210, via the support arm 240, to pivot with respect to the ground engaging portion 260. Furthermore, while stops or similar features could be included in coupler 244, some embodiments do not include such a feature as the front and back sections 262, 264 of ground engaging portion serve to prevent rotation past a certain degree in preferred embodiments. Regardless, in other embodiments, coupler may include any desirable detents or locking mechanisms to facilitate static positioning. An example of an appropriate rotation joint for use as couplers 244 is illustrated in FIGS. 7-10 of U.S. Pat. No. 6,739,649 to Brian Kelly et al.

Figure 6B:
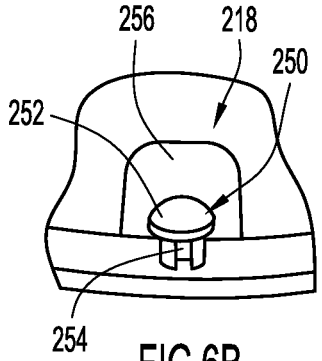
FIG. 6B shows a portion of the seat support shown in FIG. 6A.
Figure 6A:
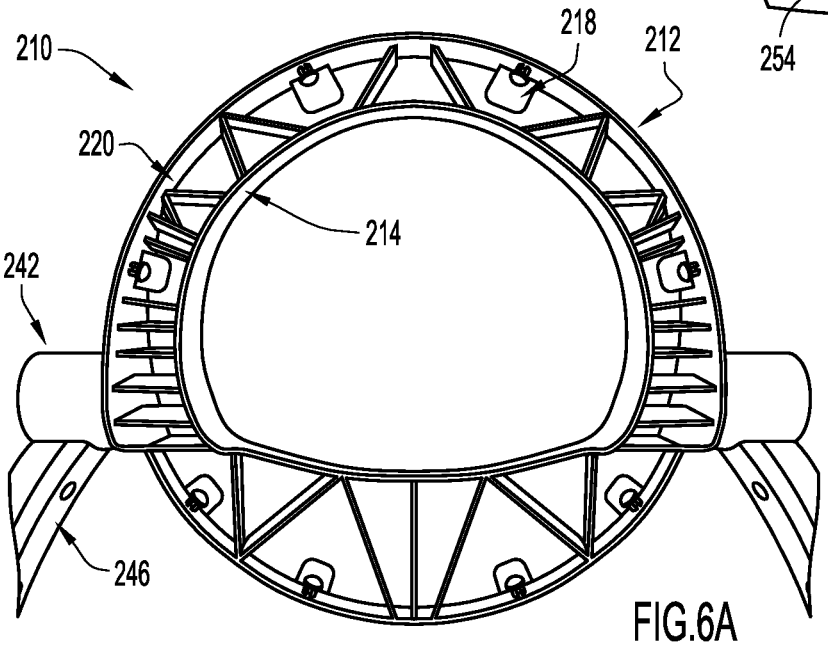
FIG. 6A shows a bottom view of an exemplary embodiment of a seat support for a support structure in accordance with the present invention.

Now turning to FIGS. 6A-6B, another exemplary seat support 210 is shown from a bottom perspective view. As mentioned above, in this embodiment, the seat support 210 includes couplers 218 configured to releasably secure a seat 100 to the seat support 210. In particular, the seat support 210 includes four couplers 218 on its front and four couplers 218 on its rear, the four couplers in the rear being configured to secure the rear wall 116 of a seat 100 and the four front couplers being configured to secure the front wall 112 of a seat 100. Each of the couplers 218 extends inwards from the outer wall 212 of the seat support 210 towards the inner wall 214, a slight distance below the lower surface 220 of the seat support 220. Preferably, the couplers 218 extend parallel to the lower surface 220.

As shown best in FIG. 6B, each of the couplers 218 includes an opening 256 and a projection 250. The projection 250 extends within the opening 256 such that there is sufficient room around the projection 250 for a parent to move each coupling portion 130 of the seat 100 adjacent each projection 250 to secure a seat 100 to the seat support 210. Moreover, in this particular embodiment, each projection 250 includes a cylindrical portion 254 and a top 252 which extends radially beyond the cylindrical portion 254. Consequently, the coupling portion 130 of the seat 100 is preferably sized so that when the coupling portion 130 is pulled over a top 252 and wrapped around the cylindrical portion 254 it will be substantially secured in place by the top 252.

Still referring to FIG. 6A, in this particular embodiment, the seat support 210 is again coupled to arms 246 via couplers 242. However, in this particular embodiment, the seat support is formed integrally with axles or axle-like portions (not shown) which may slide into and engage the couplers 242. Once engaged with the couplers 242, the seat support may be secured to the couplers 242 and, again, the couplers 242 may fix or allow limited rotation of the seat support 210 with respect to the arms 246. In this particular embodiment, the seat support 210 is limited to a rotational range of approximately 30 degrees, ranging from a substantially flat position to a position tilted slightly forward or backward (i.e. approximately 30 degrees below a horizontal axis). In other words, although formed in a different manner, the couplers 242 of this embodiment may provide substantially the same functionality as those described above.

Figure 8A:
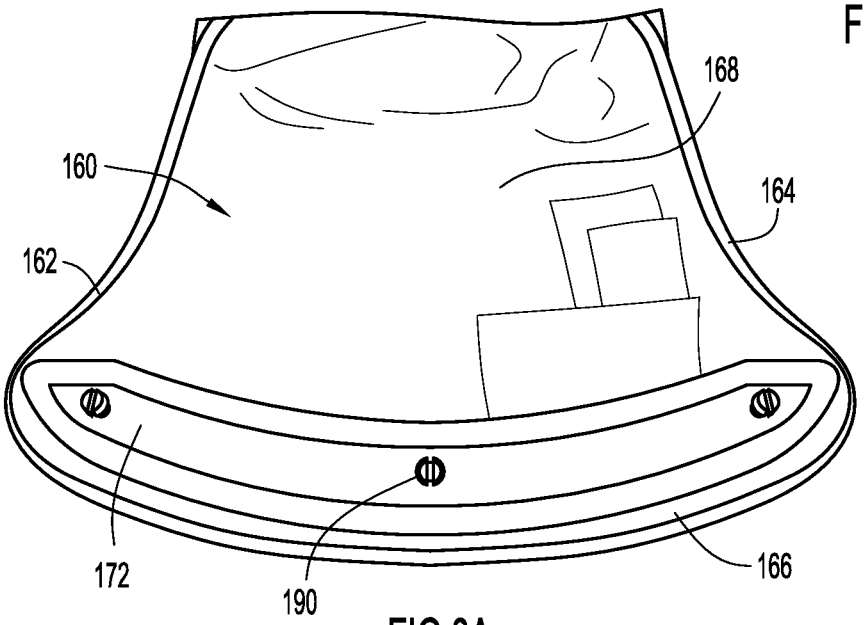
FIG. 8A shows a perspective view of the underside of a flap for another exemplary embodiment of a softgoods seat for a foldable infant positioner in accordance with the present invention.

Now turning to FIGS. 7, 8A, and 8B, the front portion 262 of a support structure 200, a flap 160, and a portion of the flap 160 are shown, respectively. As mentioned above, in some embodiments, the flap 160 of the seat 100 may be secured to the support structure 200 via couplers or fasteners. FIGS. 7, 8A, and 8B provide an exemplary embodiment of such an arrangement. Notably, in this embodiment, the top surface of the front portion 262 of the support structure includes an indentation 272 and apertures 274 while the flap 160 includes a hardgoods portion 172 with protrusions 190 formed thereon which may serve as couplers.

In this particular embodiment, the hardgoods portion is included on a bottom side 168 of the flap 160, adjacent a second end 166 and extends between a first side 162 and a second side 164 of the flap. Since flap 160 is substantially bell-shaped (i.e. first and second side 162, 164 are substantially angled away from each other and bottom 166 extends convexly therebetween), the hardgoods portion 172 is substantially arcuate. Notably, it is to be understood that the shape of the flap 160 may also be referred to as T-shaped for the purpose of this application at least because it is shaped to be formed substantially into a T-shape when used with a support structure 200. Regardless, in other embodiments, a hardgoods portion 172 of any desirable shape may be included in any desirable location. However, the hardgoods portion 172 is preferably disposed on the bottom surface 168 of the flap 160 if it is to be coupled to the support structure 200.

Due the inclusion of the aforementioned features, when the flap 160 is disposed over the front portion 262, it may be secured thereto. First, the hardgoods portion 172 may be aligned with the indentation 272. Then, once aligned, each of the protrusions 190 on the hardgoods portion 172 may be inserted into and engaged with each of the apertures 274. Notably, and as best seen in FIG. 8B, each protrusion 190 includes a cylindrical body 192 and two extensions 194 extending upwardly therefrom on either side of a central slit 196. The extensions 194 extend, at least slightly, radially beyond the cylindrical portion 192, but the inclusion of the central slot 196 allows the extensions 194 to bend inwards as they are inserted through the apertures 274. Once the extensions 194 have extended through the apertures 274, they may revert to their original positions which extend beyond the circumference of the apertures 274, thereby securing the flap 160, via the hardgoods portion 172, to the front portion 262 of the support structure 200.

Now referring generally to FIGS. 1-8B, in use, the support structure 200 may be unfolded from a folded configuration 30 to a deployed configuration 20 by rotating the support arms 240 and seat support 210 about couplers 242, 244, respectively, until the seat is in a desirable position. The seat may then, in certain embodiments, be locked in the desirable position. If the seat 100 had not previously been installed or mounted thereon, the seat 100 may then be folded over and around the top surface 216 of seat support 210 and mounted thereto via the coupling provided at coupling portions 130 and 218. Additionally, in some embodiments, the flap 160 may also be secured to a portion of the support structure 200, such as the front portion 262 in order to ensure that the flap 160 is properly positioned below an infant sitting in seat 100.

Subsequently, a child may be placed into the interior cavity 124, with his or her feet extending through openings 114 such that they may contact front flap 160. The child will then be securely seated in an upright position, able to rest on the top surface 216 that is covered by seat 100 or look around at her surroundings. If the child gets the urge to kick, she may kick, but the child will simply press down on the front flap 160 against the support surface. Regardless of how seat support 210 is coupled to the support arms 240, the inclusion of the flap 160 and the extended footprint provided by the front and back sections 262, 264 of the ground engaging portion 260 provide enough stability to prevent the support structure 200 from tipping when pressure is applied to at least one of the seat support 210 and flap 160.

While the support structure 200 and seat 100 have been described as being fabricated or constructed from hardgoods and softgoods, respectively, it is to be understood each part may be fabricated from any suitable material, or combination of materials which provides a hard or soft part, respectively. For example, some suitable materials include plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof. Preferably, the seat 100 is a cotton-based material and the support structure is a plastic-based material.

It is also to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Similarly, the terms "infant," "child," "baby" and the like are not intended to refer to children of different ages, and are interchangeably used herein to describe any young child. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant positioner comprising:

a softgoods seat including:

a child receiving portion with leg openings to allow legs of a child to extend at least forwardly of or beneath the child receiving portion; and a flap; and a support structure comprising:

a seat support, the softgoods seat being coupled to the seat support to support a child therein in an upright seated position; and a ground engaging portion configured to engage a support surface, the ground engaging portion extending beyond the periphery of the seat support and being pivotally coupled to the seat support such that the support structure is reconfigurable between a deployed configuration and a storage configuration, wherein the flap is directly coupleable to the ground engaging portion and an edge of the leg openings included in the child receiving portion in order to extend between the child receiving portion and the ground engaging portion and prevent the child's legs from directly engaging the support surface such that the infant positioner resists movement.

2. The infant positioner of claim 1, wherein the seat support is proximate to the ground engaging portion in the storage configuration and the seat support is disposed a distance above the ground engaging portion in the deployed configuration, such that the infant positioner may support a child above the support surface in the deployed configuration.

3. The infant positioner of claim 1, wherein the softgoods seat further comprises:

a top portion that is foldable with respect to the remainder of the softgoods seat, and the top portion of the softgoods seat is configured to fold around the seat support while the remainder of the seat remains disposed within and hanging below the seat support.

4. The infant positioner of claim 1, wherein the support structure includes:

at least one support arm movably coupling the seat support to the ground engaging portion.

5. The infant positioner of claim 4, wherein the at least one support arm further comprises:

a rotatable joint coupled to the ground engaging portion and allowing the at least one support arm to be rotatable with respect to the ground engaging portion.

6. The infant positioner of claim 1, wherein the flap extends outwardly from the child receiving portion.

7. The infant positioner of claim 1, wherein the ground engaging portion includes a front portion and a rear portion and the flap is removably coupleable to the front portion.

8. The infant positioner of claim 7, wherein the flap further comprises:

a hardgoods portion configured to align with and removably couple the flap to the front portion.

9. The infant positioner of claim 1, wherein the flap is substantially T-shaped.

10. An infant positioner comprising:

a softgoods seat including:

a child receiving portion including leg openings to allow legs of a child to extend below the child receiving portion and supporting a child in an upright seated position; and a flap directly coupled to an edge of the leg openings and extending between the leg openings and a support surface such that the flap prevents the infant from contacting the support surface; and a support structure configured to support the softgoods seat at a distance above the support surface, wherein a space exists between the support surface and the child receiving portion and the flap extends through the space.

11. The infant positioner of claim 10, wherein the support structure further comprises:

a seat support configured to receive the softgoods seat therein;

a ground engaging portion extending beyond the periphery of the seat support; and at least one support arm movably coupling the seat support to the ground engaging portion.

12. The infant positioner of claim 11, wherein the seat support is rotatably coupled to the at least one support arm and the at least one support arm is pivotally mounted to the ground engaging portion.

13. The infant positioner of claim 11, wherein the support structure is movable between a deployed configuration and a storage configuration, the seat support being adjacent to the ground engaging portion in the storage configuration and being disposed a distance away from the ground engaging portion in the deployed configuration.

14. The infant positioner of claim 13, wherein the infant positioner is configured to statically position an infant disposed within the child receiving portion when the support structure is in the deployed configuration.

15. The infant positioner of claim 10, wherein the support structure includes a front portion and a rear portion, the flap includes a first end and a second end, the second end being opposite the first end, and the flap is coupled to the child receiving portion at the first end and adjacent to the front portion of the support structure at the second end.

16. The infant positioner of claim 15, wherein the flap is removably coupleable to the front portion.

17. The infant positioner of claim 10, wherein the softgoods seat is removably coupled to the support structure.

18. A foldable infant positioner:

a support structure configured to engage a support surface;

a softgoods seat including leg openings configured to allow legs of a child to extend below a child receiving portion and support a child in an upright seated position, the softgoods seat being mountable on the support structure; and a flap directly coupled to an edge of the leg openings, wherein when the support structure statically supports the softgoods seat in a position above the support surface, a space exists between the support surface and the child receiving portion, and the flap extends through the space to prevent a child seated therein from directly contacting the support surface, while allowing the child seated therein to indirectly contact the support surface.

19. The foldable infant support structure of claim 18, wherein the flap extends between the child receiving portion and a portion of the support structure in direct contact with the support surface.

20. The foldable infant positioner of claim 18, wherein the support structure further comprises:

a seat support configured to removably receive the softgoods seat therein;

a ground engaging portion extending beyond the periphery of the seat support; and at least one support arm movably coupling the seat support to the ground engaging portion, so that the support structure is reconfigurable between a deployed configuration and a storage configuration.

* * * * *